US006962647B2

(12) United States Patent
Ronnila et al.

(10) Patent No.: US 6,962,647 B2
(45) Date of Patent: Nov. 8, 2005

(54) HEADBOX FOR A PAPER MACHINE, BOARD MACHINE, PULP MACHINE OR EQUIVALENT

(75) Inventors: Markku Ronnila, Huutjärvi (FI); Jaakko Jantunen, Karhula (FI); Erkki Ilmoniemi, Vaajakoski (FI)

(73) Assignee: Metso Paper, Inc., Helsinki (FI)

( * ) Notice: Subject to any disclaimer, the term of this patent is extended or adjusted under 35 U.S.C. 154(b) by 36 days.

(21) Appl. No.: 10/275,616

(22) PCT Filed: May 3, 2001

(86) PCT No.: PCT/FI01/00421

§ 371 (c)(1),
(2), (4) Date: Apr. 21, 2003

(87) PCT Pub. No.: WO01/86062

PCT Pub. Date: Nov. 15, 2001

(65) Prior Publication Data

US 2003/0159791 A1 Aug. 28, 2003

(30) Foreign Application Priority Data

May 8, 2000 (FI) ..... 20001067

(51) Int. Cl.[7] ..... D21F 1/00; D21F 1/06

(52) U.S. Cl. ..... 162/336; 162/343; 162/341; 162/344; 162/216

(58) Field of Search ..... 162/336, 343, 162/341, 344, 216

(56) References Cited

U.S. PATENT DOCUMENTS

| | | | | |
|---|---|---|---|---|
| 3,954,558 A | | 5/1976 | Egelhof | |
| 4,285,767 A | | 8/1981 | Page | |
| 4,897,160 A | | 1/1990 | Wolf et al. | |
| 5,110,416 A | * | 5/1992 | Linsuri et al. | 162/343 |
| 5,603,807 A | * | 2/1997 | Heinzmann | 162/343 |
| 5,814,191 A | | 9/1998 | Huovila | |

FOREIGN PATENT DOCUMENTS

| | | |
|---|---|---|
| DE | 31 44 066 A1 | 5/1983 |
| FI | 2134/74 | 1/1975 |
| FI | 56221 | 8/1979 |
| FI | 7934/84 | 6/1981 |
| GB | 1 475 566 | 6/1977 |

OTHER PUBLICATIONS

International Preliminary Examination Report issued in International Patent Application No. PCT/F101/99421.
International Search Report issued in International Patent Application No. PCT/F101/00421.
Search Report issued in Finnish Priority Application No. 20001067.

* cited by examiner

*Primary Examiner*—Mark Halpern
(74) *Attorney, Agent, or Firm*—Stiennon & Stiennon

(57) ABSTRACT

A headbox, for example, in a pulp or board machine, is suitable for high basis weights which are over 400 g/m$^2$ and for high fiber suspension consistencies which are in a range of 2–5%. The headbox has a turbulence part (1), into which a fiber suspension flows from a tube bank (2), and a slice part (3) which is situated after the turbulence part and from which the fiber suspension flows to a forming section of a fibrous web. The turbulence part (1) of the headbox has at least two passages (5, 6), which converge in the flow direction of the fiber suspension towards the slice part (3). In that connection, the fiber suspension flow is first fluidized in a tortuous turbulence passage part (11) and, after that, it decelerates in another widening deceleration passage (12).

20 Claims, 1 Drawing Sheet

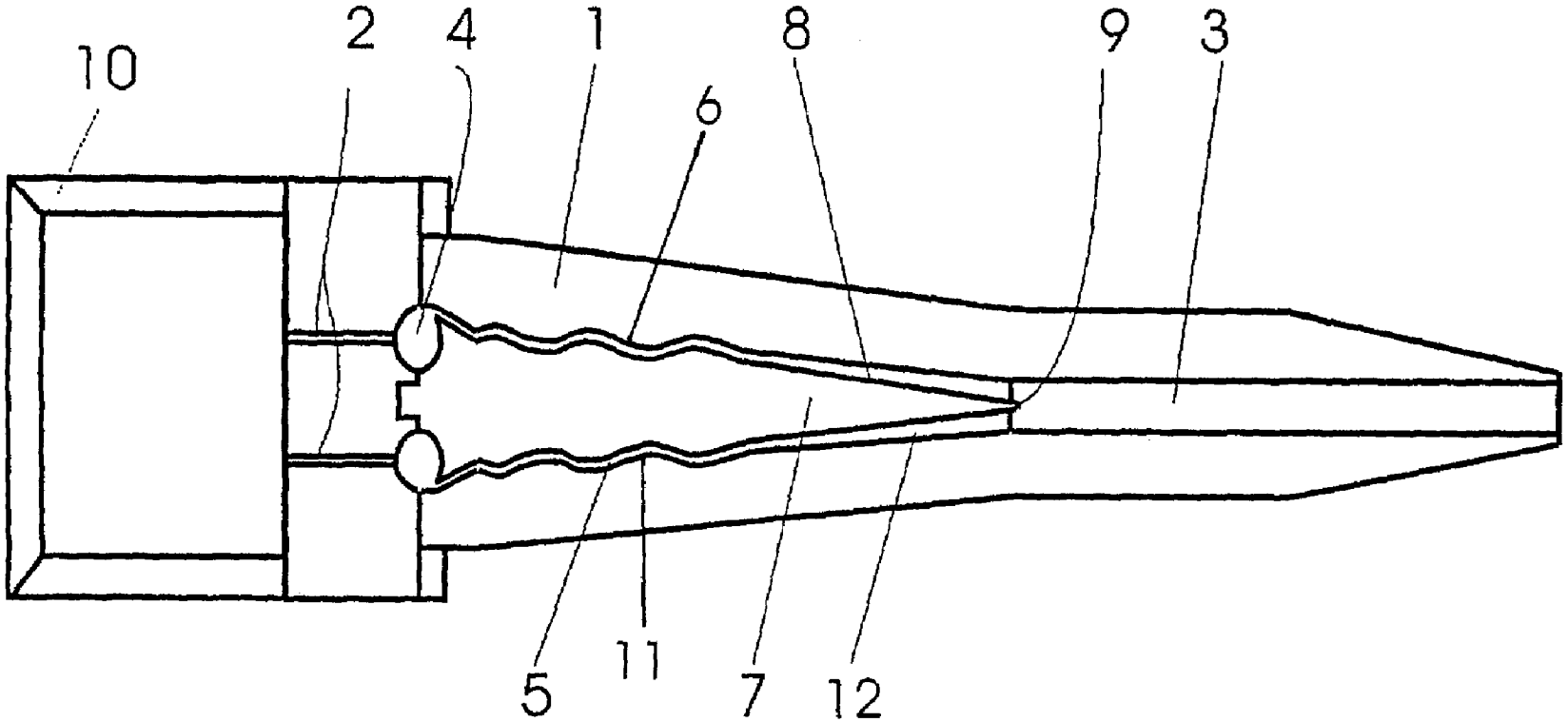
3
9
8
6
1
4
2
10
12
7
11
5

HEADBOX FOR A PAPER MACHINE, BOARD MACHINE, PULP MACHINE OR EQUIVALENT

CROSS REFERENCES TO RELATED APPLICATIONS

This application is a U.S. national stage application of International Application No. PCT/FI01/00421, filed May 3, 2001, and claims priority on Finnish Application No. 20001067 filed May 8, 2000, the disclosures of both of which application are incorporated by reference herein.

STATEMENT AS TO RIGHTS TO INVENTIONS MADE UNDER FEDERALLY SPONSORED RESEARCH AND DEVELOPMENT

Not application

BACKGROUND OF THE INVENTION

The present invention relates to paper machines, board machines, pulp machines or equivalent. More specifically, the present invention relates to a headbox [according to the preamble of claim 1, which headbox is ] suitable for high basis weights and high fibre suspension consistencies.

This kind of conventional headbox of a paper machine or board machine or pulp machine or equivalent is thus, for example, of the kind comprising a turbulence part for producing a turbulent fibre suspension flow, into which turbulence part a fibre suspension is coming from a distributor means of the fibre suspension, advantageously a tube bank, and a slice part after the turbulence part, from which slice part the fibre suspension flows to a forming section of a fibrous web.

U.S. Pat. No. 4,285,767, Beloit Corp., discloses a headbox for a high consistency fibre suspension. The U.S. patent proposes a flow passage, which is adjustable in its cross-sectional flow area and narrows stepwise towards a slice part, for a fibre suspension flowing in a foamed state in order that it might be assured that the fibres are uniformly distributed in the fibre suspension. The fibre suspension is passed into the stepped passage from a distributor means of the fibre suspension through tube passages; according to the U.S. patent, the cross-sectional flow area is adjusted by moving a spindle part of the headbox axially away from and towards a slice part in order to increase and, correspondingly, to decrease the cross-sectional flow area.

The use of high consistency and the suitability of today's headboxes for use as high consistency headboxes involve a risk of cavitation and the fact that the use of high consistency requires fluidization of the fibre suspension in order that the fibres might be caused to be distributed uniformly in the fibre suspension and that the quality of the web might be made satisfactory. On the other hand, increase of fluidization limits increase of basis weight, for example, in pulp-drying machines and board machines.

SUMMARY OF THE INVENTION

It is an object of the present invention to eliminate or at least reduce the above-noted problems associated with the use of high consistency and to provide an improved headbox which is suitable for high fibre suspension consistencies which are in a range of 2–5%. The device according to the invention is particularly suitable for high basis weights of over 400 g/m$^2$, which are used in pulp-drying machines.

This objective is achieved by means of the headbox mentioned at the beginning, the characteristic features of the headbox being set forth in the appended claims.

The invention is thus based on the novel and inventive basic idea that a fibre suspension is discharged from distribution equipment of the fibre suspension into an explosion chamber that equalizes the transverse flow profile. After that, the fibre suspension flow passes into a turbulence part which comprises a double passage construction for the fibre suspension flow, the passages of which construction converge in the flow direction towards each other and in which construction the fibre suspension flow is first fluidized in first tortuous turbulence passages and then it slows down, advantageously close to running speed, in second widening deceleration passages. Finally, the fibre suspension flows are combined in a slice part after the turbulence part, in which connection it is advantageous that the water boundary layer situated on the surface of the turbulence part is broken.

In accordance with an advantageous embodiment of the invention, in the turbulence part, the angle of widening of an individual deceleration passage of the fibre suspension flow has been selected such that the suspension cannot become separated from the wall. In that connection, the angle is in a range of 0.5–7°, advantageously in a range of 2–3°, in which connection the risk of cavitation is minimized.

In accordance with the invention, it is additionally advantageous that the end of the spindle part defining the turbulence and deceleration passages on the inside is blunt and that the angle between the wall surfaces of the deceleration passages for the fibre suspension flows converging towards the end of the spindle part is about 8–16°.

It is also advantageous to the invention that the height of the slice part is selected such that the flow rate of the suspension flow slowed down in the deceleration passage is maintained in the slice part in order to eliminate flocculation. In that connection, it is particularly advantageous, when the turbulence part has a double passage structure, that the cross-sectional flow area in the slice part is twice the cross-sectional flow area of a single deceleration passage, preferably at the outlet end of the deceleration passage. When the turbulence part has a triple passage construction, for maintaining the flow rate of the suspension flow and for preventing flocculation it is advantageous that the cross-sectional flow area in the slice part is three times the cross-sectional flow area of a single deceleration passage, preferably at the outlet end of the deceleration passage.

In the headbox according to the invention is it also possible to use methods of regulating the basis weight profile which are known in themselves and in which the basis weight profile is regulated by means of dilution water. Such a regulation method is described in U.S. Pat. No. 5,814,191. In addition, it is possible to adjust the height of the slice opening across the width of the headbox, by means of which the basis weight profile and/or fibre orientation is/are regulated. Both regulation methods can also be used simultaneously.

With regard to the advantages of the invention, it may be mentioned that, for example, in pulp machines, investment savings are of the order of 3.5–5.9 million euros with the current cost structure and, because of smaller flow volumes in the short circulation and in the wire section, annual pumping savings can be achieved which are of the order of 0.15–0.35 million euros with the current cost structure. A further advantage is that the capacity of old machines can be increased in connection with rebuilding.

BRIEF DESCRIPTION OF THE DRAWINGS

In the following, the invention will be described in greater detail with reference to the appended patent drawing, which is a longitudinal sectional view of an embodiment of the invention regarded as advantageous.

The FIGURE is a vertical longitudinal sectional view of a headbox according to the invention in the flow direction of a fibre suspension, i.e. in the machine direction.

DESCRIPTION OF THE PREFERRED EMBODIMENTS

As shown in the FIGURE, the headbox according to the invention includes a turbulence part 1 which has a double passage structure and into which a fibre suspension flows from a fibre suspension distributor means 2, which is advantageously a tube bank, and a slice part 3. The fibre suspension flows passing as separate flows from each other in the turbulence part 1 are combined in the slice part 3, after which the combined fibre suspension flow passes to a forming section of a fibrous web (not shown in the FIGURE). Moreover, the headbox comprises an inlet header 10, by means of which the fibre suspension flow is distributed evenly across the entire width of the headbox.

In accordance with the invention, the headbox which is intended for high basis weights of over 400 g/m$^2$ and for high fibre suspension consistencies in a range of 2–5% comprises an explosion chamber 4 for receiving the fibre suspension from the tube bank 2, which explosion chamber equalizes the transverse flow profile of the fibre suspension flow.

In addition, in accordance with the invention, the turbulence part 1 after the explosion chamber has a structure comprising at least two passages, advantageously a double or triple passage structure, the passages 5, 6 of which converge towards each other in the flow direction of the fibre suspension, in which connection the fibre suspension flow in each passage is first fluidized in a first passage part, which is a tortuous turbulence passage part 11, and after that it decelerates, advantageously close to running speed, in a second passage part, which is a deceleration passage part 12, which continuously widens up to the slice part 3. In that connection, it is advantageous that, in the turbulence part 1, the angle of widening of an individual deceleration passage part 12 is in a range of 0.5–7°, advantageously in a range of 2–3°. Too small or too large an angle of widening leads to insufficient or excessive deceleration, respectively, in which case too great a difference between the running or production speed of the machine and the flow rate of the fibre suspension to the web forming section becomes a problem.

In accordance with an advantageous embodiment of the invention, an explosion chamber 4 has been arranged at the initial end of both passages of the turbulence part 1 having a double passage construction. Alternatively, the explosion chambers 4 can be arranged so as to form an extension of the tube bank 2, in which connection the fibre suspension flows into both passages 5, 6 of the turbulence part 1 from the explosion chambers preceding the passages.

As shown in the FIGURE, both passages 5, 6 of the turbulence part 1 of the headbox according to the invention are defined by a central spindle part 7 and the fibre suspension flows are combined in the slice part 3 situated after the turbulence part 1 such that the water boundary layer on the surface of the spindle part 7 of the turbulence part 1 is broken. In that connection, it is advantageous in accordance with the invention that the end 8 of the spindle part 7 defining the turbulence and/or deceleration passer parts 11, 12 on the inside is blunt, and that the walls 9 of the spindle part 7 defining the widening deceleration passage parts 12 converge towards the blunt end 8 of the spindle part. In accordance with the invention, an advantageous angle between the converging walls 9 is in a range of 8–16°, for example, about 11–12°.

In the headbox according to a preferred embodiment of the invention, the height of the slice part 3 has been selected such that the flow rate of the suspension flow decelerated in the deceleration passage part 12 is maintained in the slice part 3, whereby the risk of flocculation can be eliminated. In addition, the length of the slice part 3 has been selected such that the suspension flows coming from the deceleration passage part 12 have time to be mixed before discharge to the web forming section. Further, it is advantageous that the cross-sectional flow area in the slice part 3 is, in relation to the cross-sectional flow area of a single deceleration passage part 12, in particular at the outlet side end of the deceleration passage part 12, double when the turbulence part 1 comprises two passages, treble when the turbulence part comprises three passages (not shown in the FIGURE), quadruple when the turbulence part comprises four passages (not shown in the FIGURE), i.e. the cross-sectional flow area of the slice part 3 corresponds to a multiple of the cross-sectional flow area of a single deceleration passage part 12 depending on the passage construction of the turbulence part 1.

Above, the invention has been described only by way of example by means of one of its embodiments regarded as advantageous. Of course, this is not intended to limit the invention and, as is clear to a person skilled in the art, the invention can be varied and modified within the scope of protection of the inventive idea defined in the appended claims.

What is claimed is:

1. A headbox for a paper machine, board machine, or pulp machine, which headbox is suitable for high fibre suspension consistencies which are in a range of 2–5%, and which headbox includes a turbulence part for producing a turbulent fibre suspension flow, into which turbulence part a fibre suspension flows from a fibre suspension distributor means, wherein the fiber suspension distributor means comprises a tube bank, and further comprising a plurality of explosion chambers before the turbulence part which receive the fibre suspension from the distributor means and which each equalize the transverse flow profile of the fibre suspension flow, and a slice part which is situated after the turbulence part and from which the fibre suspension flows to a forming section of a fibrous web, wherein the turbulence part comprises at least two passages, which converge in the flow direction of the fibre suspension towards the slice part of the headbox, in which connection the fibre suspension flow in each of the at least two passages is first fluidized in a tortuous turbulence passage part and, after that, it decelerates in a widening deceleration passage part, and wherein a separate explosion chamber is positioned before each of the at least two passages.

2. The headbox of claim 1 wherein the turbulence part begins at an initial end, and wherein the explosion chamber is at the initial end of the turbulence part.

3. The headbox of claim 1 wherein the fibre suspension flows are combined in the slice part after the turbulence part so that the water boundary layer on a surface of a spindle part in the turbulence part is broken.

4. The headbox of claim 1 wherein in the turbulence part, each deceleration passage part has an angle of widening in a range of 0.5–7°.

5. The headbox of claim 4 wherein the angle of widening is in a range of 2–3°.

6. The headbox of claim 1 wherein a spindle part has portions which define the turbulence passage parts and/or the deceleration passage parts, and the spindle part has a blunt end.

7. The headbox of claim 6 wherein the spindle part has walls which define portions of the widening deceleration passages which converge towards the blunt end of the spindle part, the angle of convergence of said walls being in a range of 8–16°.

8. The headbox of claim 1 wherein the flow rate of the suspension flow decelerated in the deceleration passage parts is maintained in the slice part.

9. The headbox of claim 8 wherein the turbulence part has two deceleration passage parts, and wherein the cross-sectional flow area in the slice part is twice the cross-sectional flow area of a single deceleration passage part.

10. The headbox of claim 8 wherein the cross-sectional flow area of the slice part corresponds to the number of deceleration passage parts multiplied by the cross-sectional flow area of a single deceleration passage part.

11. The headbox of claim 1 wherein the headbox is suitable for high basis weights of over 400 g/m$^2$.

12. The headbox of claim 1 wherein the widening deceleration passage part of each passage is configured to decelerate the flow to close to running speed.

13. A headbox for a paper machine, board machine, or pulp machine, suitable for high fibre suspension consistencies which are in a range of 2–5%, the headbox comprising:

a fibre suspension distributor, wherein the fiber suspension distributor comprises a tube bank;

a turbulence part for producing a turbulent fibre suspension flow, into which a fibre suspension flows from the fiber suspension distributor;

a slice part which is situated after the turbulence part and from which the fibre suspension flows to a forming section of a fibrous web; and wherein the turbulence part comprises at least two passages, which converge in the flow direction of the fibre suspension towards the slice part, and each of the two passages has a tortuous turbulence passage part followed by a widening deceleration passage part, wherein each of the at least two passages has an explosion chamber positioned between said passage and the distributor, the explosion chambers equalizing the transverse flow profile of the fibre suspension flow.

14. The headbox of claim 13 wherein in the turbulence part, each deceleration passage part has an angle of widening in a range of 0.5–7°.

15. The headbox of claim 13 wherein a spindle part has portions which define the turbulence passage parts and/or the deceleration passage parts, and the spindle part has a blunt end.

16. The headbox of claim 15 wherein the spindle part has walls which define portions of the widening deceleration passages which converge towards the blunt end of the spindle part, the angle of convergence of said walls being in a range of 8–16°.

17. An assembly of a headbox for a paper machine, board machine, or pulp machine and a high fibre suspension, the assembly comprising:

a high fibre suspension having fiber consistencies in a range of 2–5% flowing through the headbox;

a fibre suspension distributor comprised of a tube bank;

a turbulence part for producing a turbulent fibre suspension flow, into which the fibre suspension flows from the fiber suspension distributor, the turbulence part being comprised of at least two passages which converge in the flow direction of the fibre suspension towards a slice part, wherein each of the two passages has a tortuous turbulence passage part followed by a widening deceleration passage part, the slice part being situated after the turbulence part and from which the fibre suspension flows to a forming section of a fibrous web, wherein each of the at least two passages has an explosion chamber positioned between said passage and the distributor, the explosion chambers equalizing the transverse flow profile of the fibre suspension flow.

18. The headbox of claim 17 wherein in the turbulence part, each deceleration passage part has an angle of widening in a range of 0.5–7°.

19. The headbox of claim 19 wherein a spindle part has portions which define the turbulence passage parts and/or the deceleration passage parts, and the spindle part has a blunt end.

20. The headbox of claim 19 wherein the spindle part has walls which define portions of the widening deceleration passages which converge towards the blunt end of the spindle part, the angle of convergence of said walls being in a range of 8–16°.

* * * * *

UNITED STATES PATENT AND TRADEMARK OFFICE

CERTIFICATE OF CORRECTION

PATENT NO. : 6,962,647 B2
APPLICATION NO. : 10/275616
DATED : November 8, 2005
INVENTOR(S) : Markku Ronnila et al.

It is certified that error appears in the above-identified patent and that said Letters Patent is hereby corrected as shown below:

On the title page item (56), under the heading "OTHER PUBLICATIONS" on the cover page, "PCT/FI01/99421" should be --PCT/FI01/00421--.

In Column 6, line 38, "The headbox of claim 19" should be --The headbox of claim 17--.

Signed and Sealed this

Eleventh Day of November, 2008

JON W. DUDAS
*Director of the United States Patent and Trademark Office*